US010393340B1

(12) United States Patent
Zhang

(10) Patent No.: US 10,393,340 B1
(45) Date of Patent: Aug. 27, 2019

(54) SELF-HEATING ANTI-ICE-SNOW LED WORKING LAMP

(71) Applicant: FoShan Brighter LED Lighting Co., Ltd., Foshan (CN)

(72) Inventor: Xiangcheng Zhang, Pingjiang (CN)

( * ) Notice: Subject to any disclaimer, the term of this patent is extended or adjusted under 35 U.S.C. 154(b) by 0 days.

(21) Appl. No.: 16/180,141

(22) Filed: Nov. 5, 2018

(51) Int. Cl.

| | |
|---|---|
| ***F21V 29/00*** | (2015.01) |
| ***F21S 45/60*** | (2018.01) |
| ***F21K 9/20*** | (2016.01) |
| ***F21K 9/66*** | (2016.01) |
| ***H05B 33/08*** | (2006.01) |
| ***F21V 23/00*** | (2015.01) |
| ***F21V 23/06*** | (2006.01) |
| ***F21V 7/00*** | (2006.01) |
| ***F21V 13/04*** | (2006.01) |

(52) U.S. Cl.
CPC ..... *F21S 45/60* (2018.01); *F21K 9/20* (2016.08); *F21K 9/66* (2016.08); *F21V 7/0091* (2013.01); *F21V 13/04* (2013.01); *F21V 23/005* (2013.01); *F21V 23/06* (2013.01); *H05B 33/0815* (2013.01)

(58) Field of Classification Search
CPC ..... F21S 45/60; F21V 13/04; F21V 7/0091; F21V 23/06; F21V 23/005; H05B 33/0815; F21K 9/66; F21K 9/20
See application file for complete search history.

(56) References Cited

U.S. PATENT DOCUMENTS

| | | | | |
|---|---|---|---|---|
| 3,832,527 | A * | 8/1974 | Nagasima | B60S 1/586 200/61.05 |
| 5,346,770 | A * | 9/1994 | Osada | B32B 17/10036 428/334 |
| 5,493,102 | A * | 2/1996 | Takase | B32B 17/10 219/203 |
| 6,765,177 | B2 * | 7/2004 | Noguchi | B32B 17/10036 219/203 |
| 8,530,792 | B2 * | 9/2013 | Dyrdek | H05B 3/84 219/202 |
| 8,653,419 | B2 * | 2/2014 | Weiss | H05B 3/84 219/202 |
| 2006/0185261 | A1 * | 8/2006 | Ashton | H05B 3/84 52/38 |
| 2009/0034231 | A1 * | 2/2009 | Chu | F21V 29/004 362/92 |
| 2013/0249375 | A1 * | 9/2013 | Panagotacos | H05B 33/0803 313/13 |
| 2017/0108197 | A1 * | 4/2017 | Cacciabeve | F21V 15/04 |

* cited by examiner

*Primary Examiner* — Tracie Y Green
(74) *Attorney, Agent, or Firm* — Jie Yang; HYIP

(57) ABSTRACT

A self-heating anti-ice-snow LED working lamp comprising a rear shell, a printed circuit board, a lens/reflector cup, a front cover, a mounting support and a power cord; the rear shell and the front cover are connected in a matched mode; the printed circuit board, the lens/reflector cup and an electric heating glass are sequentially arranged on the inner side of the rear shell from the inside out; a waterproof rubber ring is arranged between the lens/reflector cup and the electric heating glass; a pair of electrodes is symmetrically arranged on the electric heating glass; a temperature controller is arranged on the inner side surface of the electric heating glass; the lamp cover is an electric heating glass with a high transparency.

10 Claims, 3 Drawing Sheets

SELF-HEATING ANTI-ICE-SNOW LED WORKING LAMP

TECHNICAL FIELD OF THE INVENTION

The present invention relates to the technical field of LED lamps, and more particularly, to a self-heating anti-ice-snow LED working lamp.

BACKGROUND OF THE INVENTION

In the prior art, working lamps adopt LEDs as the light source. The heat produced by an LED light source is far lower than that produced by a traditional halogen lamp. It's easier for snowflakes to accumulate on or even freeze the lamp cover of an LED working lamp. As a result, the luminous efficacy of the working lamp can be greatly reduced, and even worse, a user's sight can be seriously blocked.

In order to solve the aforesaid problems, various technical solutions are proposed by those skilled in this art, wherein one of them is to distribute heating wires over the surface of the lamp cover, thereby heating the lamp cover wholly. Its operating principle resembles that of the heating lamp covers of automobiles. This solution has the following shortcomings: first, for the heating wires are relatively thin, the lamp cover cannot be uniformly heated unless a large number of heating wires are distributed on the lamp cover; moreover, the densely distributed heating wires seriously block the light emitted by the light source, resulting in a low luminous efficacy of the working lamp; second, as the strip-shaped heating wires are very thin, and must endure an ultra-high temperature, they can easily fall off after prolonged use. Thus, the functional life of the working lamp can be greatly shortened.

SUMMARY OF THE INVENTION

The purpose of the present invention is to solve the shortcomings in the prior art by providing a self-heating anti-ice-snow LED working lamp.

To achieve the above purpose, the present invention adopts the following technical solution:

A self-heating anti-ice-snow LED working lamp comprising a rear shell, a printed circuit board, a lens/reflector cup, a front cover, a mounting support and a power cord; the rear shell and the front cover are connected in a matched mode; the printed circuit board, the lens/reflector cup and an electric heating glass are sequentially arranged on the inner side of the rear shell from the inside out; a waterproof rubber ring is arranged between the lens/reflector cup and the electric heating glass; a pair of electrodes is symmetrically arranged on the electric heating glass; a temperature controller is arranged on the inner side surface of the electric heating glass; the temperature controller is provided with two wires, wherein one wire is connected with the electrode on one side of the electric heating glass, and the other wire is connected with the printed circuit board; the electrode on the other side of the electric heating glass is connected with the printed circuit board.

In another aspect of the present invention, the rear shell and the front cover are detachably connected through a plurality of screws.

In another aspect of the present invention, a mounting support is installed on the outer side of the rear shell through screws, and the mounting support can be adjusted and rotated relative to the rear shell.

In another aspect of the present invention, the two electrodes are symmetrically arranged, and are in an opaque state.

In another aspect of the present invention, the distance between the temperature controller and the surface of the electric heating glass is smaller than 2 mm.

In another aspect of the present invention, the printed circuit board is provided with an LED driving circuit, an LED light source, an LED indicator, a power input interface and an electric heating glass control output interface.

In another aspect of the present invention, the electric heating glass is made by uniformly plating a transparent conductive film layer on the full transparent toughened glass material.

Compared with the prior art, the present invention has the following advantages:

The lamp cover of the present invention is an electric heating glass with a high transparency. The internal transparent conductive film does not affect the light output of the working lamp. The lamp cover heats uniformly, ensuring a long functional life of the working lamp. After adopting the temperature controller, the surface temperature of the electric heating glass can be effectively controlled, achieving an automatic removal of snow and ice.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

MARKING INSTRUCTIONS OF THE DRAWINGS

1—Screw, 2—Rear Shell, 3—Printed Circuit Board, 4—Lens/Reflector Cup, 5—Waterproof Rubber Ring, 6—Electric Heating Glass, 7—Front Cover, 8—Temperature Controller, 9—Mounting Support, 10—Power Cord, 11—A Pair of Electrodes

DETAILED DESCRIPTION OF THE INVENTION

Drawings and detailed embodiments are combined hereinafter to elaborate the technical principles of the present invention.

Figure 1:
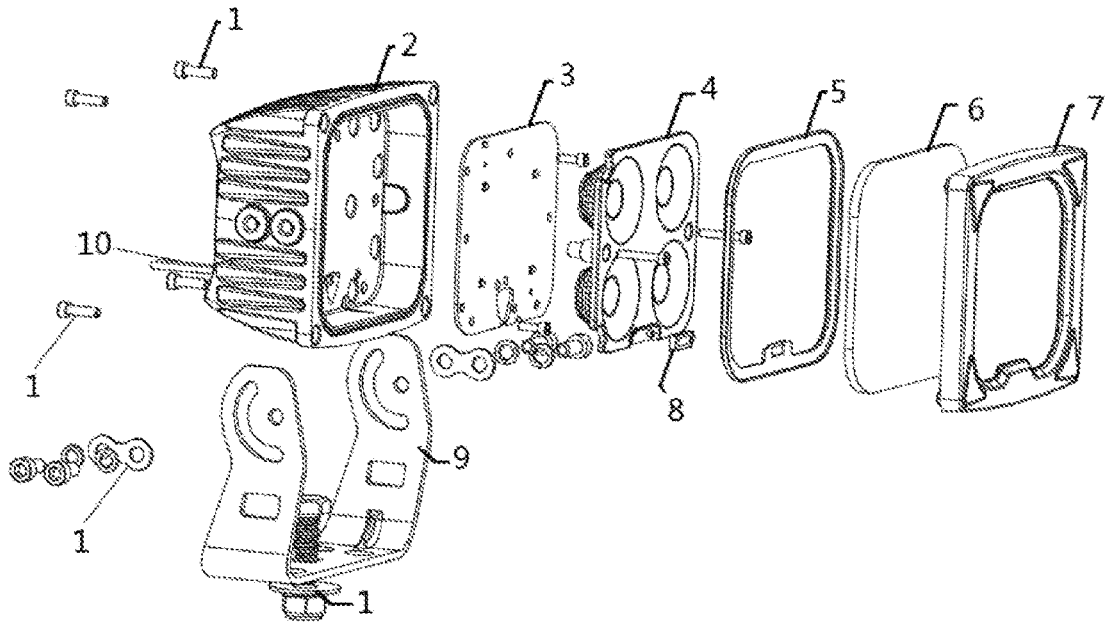
FIG. 1 is an explosive view of the present invention.
Figure 2:
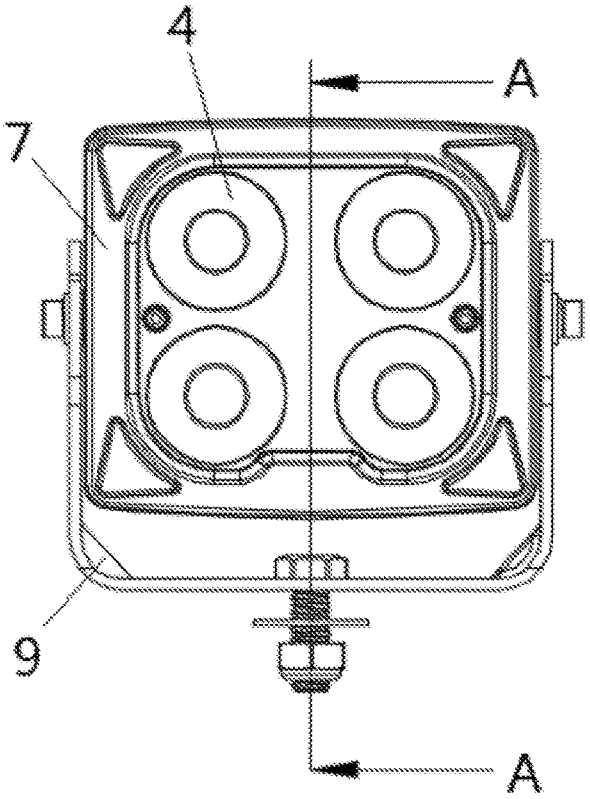
FIG. 2 is a front view of the present invention.
Figure 3:
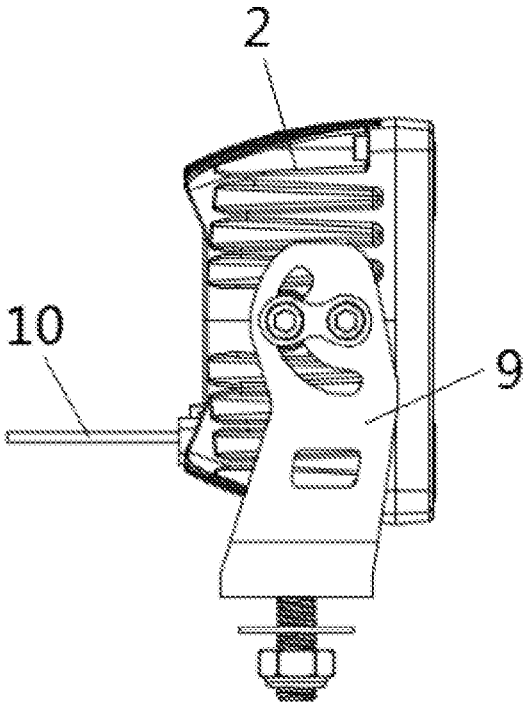
FIG. 3 is a side view of the present invention.
Figure 4:
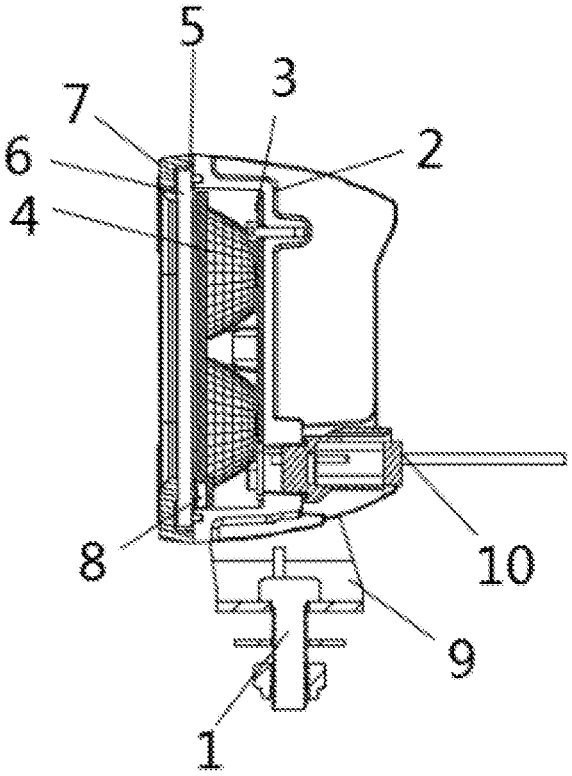
FIG. 4 is a sectional view taken along line A-A in FIG. 2.
Figure 5:
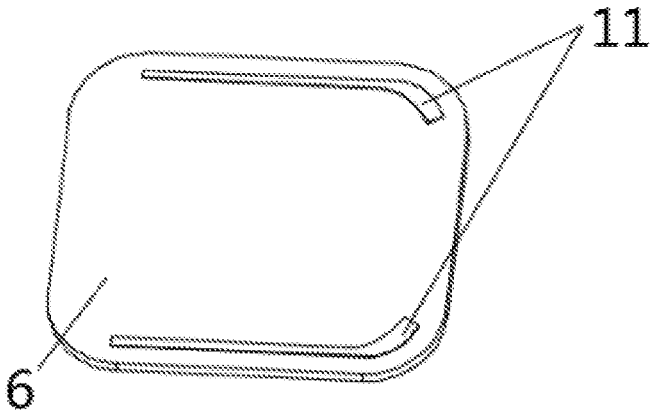
FIG. 5 is a structural diagram of the electric heating glass of the present invention.
Figure 6:
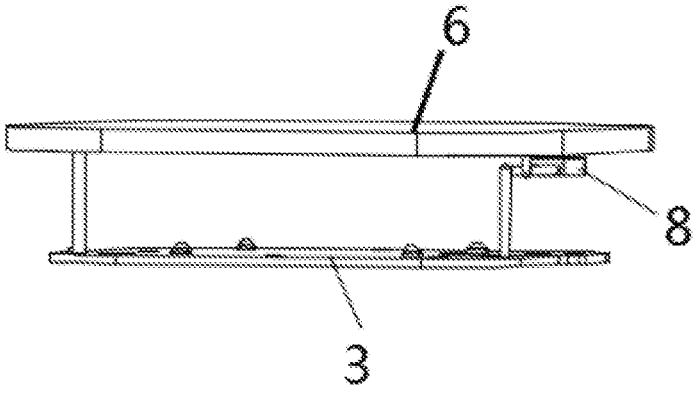
FIG. 6 is a structural diagram showing the connection among the electric heating glass, the printed circuit board and the temperature controller.

As shown in FIGS. 1-6, in this embodiment, the self-heating anti-ice-snow LED working lamp of the present invention comprises a rear shell 2, a printed circuit board 3, a lens/reflector cup 4, a front cover 7, a mounting support 9 and a power cord 10. The rear shell 2 and the front cover 7 are detachably connected through a plurality of screws 1. The printed circuit board 3, the lens/reflector cup 4 and an electric heating glass 6 are sequentially arranged on the inner side of the rear shell 2 from the inside out. A waterproof rubber ring 5 is arranged between the lens/reflector cup 4 and the electric heating glass 6, and a mounting support 9 is installed on the outer side of the rear shell 2 through screws 1. The mounting support 9 can be adjusted and rotated relative to the rear shell 2, enabling the working lamp to be conveniently installed at different angles.

A pair of electrodes (a positive electrode and a negative electrode) 11 is symmetrically arranged on the electric heating glass 6. The pair of electrodes 11 is opaque. The outer side of the electric heating glass 6 is provided with only one pair of electrodes 11 in the central light-emitting area of the working lamp instead of a large number of heating wires. This design can prevent the light output of the working lamp from being reduced. A temperature controller 8 is arranged on the inner side surface of the electric heating glass 6, and the distance between the temperature controller 8 and the surface of the electric heating glass 6 is smaller than 2 mm. The temperature controller 8 is provided with two wires, wherein one wire is connected with the electrode on one side of the electric heating glass 6, and the other wire is connected with the printed circuit board 3. The electrode on the other side of the electric heating glass 6 is connected with the printed circuit board 3. The printed circuit board 3 is provided with an LED driving circuit, an LED light source, an LED indicator, a power input interface and an electric heating glass control output interface. During the operation of the working lamp, when the surface temperature of the electric heating glass 6 monitored by the temperature controller 8 is lower than 30° C., the temperature controller 8 is switched on. The electric heating glass 6 automatically starts heating, and the LED indicator on the printed circuit board 3 is turned on. When the surface temperature of the electric heating glass 6 is greater than 50° C., the temperature controller is switched off. At this point, the electric heating glass 6 stops heating, and the LED indicator on the printed circuit board 3 is turned off.

To overcome the prior technical problems, the lamp cover of the LED working lamp of the present invention adopts a full transparent electric heating glass material. The electric heating glass 6 is made by uniformly plating a transparent conductive film layer on the full transparent toughened glass material. A pair of electrodes are symmetrically arranged on the outer side of the electric heating glass 6. The two electrodes are respectively connected with the printed circuit board 3. When the printed circuit board 3 is switched on, the resistors on the surface of the transparent conductive film layer start uniformly heating the lamp cover, thereby melting the snow and ice thereon. Moreover, the temperature controller 9 arranged underneath the electric heating glass lamp cover can monitor the surface temperature of the lamp cover. During operation, when the surface temperature of the lamp cover monitored by the temperature controller 8 is lower than 30° C., the temperature controller 8 is switched on, and the lamp cover automatically starts heating. When the surface temperature of the lamp cover is greater than 50° C., the temperature controller is switched off, and the lamp cover automatically stops heating. After the whole working lamp is assembled, there's no presence of heating wires on the front of the lamp cover.

The lamp cover of the present invention is an electric heating glass with a high transparency. The internal transparent conductive film does not affect the light output of the working lamp. The lamp cover heats uniformly, ensuring a long functional life of the working lamp. After adopting the temperature controller, the surface temperature of the electric heating glass can be effectively controlled, achieving an automatic removal of snow and ice.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A self-heating anti-ice-snow LED working lamp, comprising:

a rear shell, a printed circuit board, a lens/reflector cup, a front cover, a mounting support, and a power cord, wherein the rear shell and the front cover are connected in a matched mode, wherein the printed circuit board, the lens/reflector cup and an electric heating glass are sequentially arranged on the inner side of the rear shell from the inside out, wherein a waterproof rubber ring is arranged between the lens/reflector cup and the electric heating glass, wherein a pair of electrodes is symmetrically arranged on the electric heating glass, wherein a temperature controller is arranged on the inner side surface of the electric heating glass, wherein the temperature controller is provided with two wires, wherein one wire is connected with the electrode on one side of the electric heating glass, and the other wire is connected with the printed circuit board, wherein the electrode on the other side of the electric heating glass is connected with the printed circuit board.

2. The self-heating anti-ice-snow LED working lamp of claim 1, wherein the rear shell and the front cover are detachably connected through a plurality of screws.

3. The self-heating anti-ice-snow LED working lamp of claim 1, wherein a mounting support is installed on the outer side of the rear shell through screws, and the mounting support can be adjusted and rotated relative to the rear shell.

4. The self-heating anti-ice-snow LED working lamp of claim 1, wherein the two electrodes are symmetrically arranged, and are in an opaque state.

5. The self-heating anti-ice-snow LED working lamp of claim 1, wherein the distance between the temperature controller and the surface of the electric heating glass is smaller than 2 mm.

6. The self-heating anti-ice-snow LED working lamp of claim 1, wherein the printed circuit board is provided with an LED driving circuit, an LED light source, an LED indicator, a power input interface and an electric heating glass control output interface.

7. The self-heating anti-ice-snow LED working lamp of claim 1, wherein the electric heating glass is made by uniformly plating a transparent conductive film layer on the full transparent toughened glass material.

8. The self-heating anti-ice-snow LED working lamp of claim 4, wherein the electric heating glass is made by uniformly plating a transparent conductive film layer on the full transparent toughened glass material.

9. The self-heating anti-ice-snow LED working lamp of claim 5, wherein the electric heating glass is made by uniformly plating a transparent conductive film layer on the full transparent toughened glass material.

10. The self-heating anti-ice-snow LED working lamp of claim 6, wherein the electric heating glass is made by uniformly plating a transparent conductive film layer on the full transparent toughened glass material.

* * * * *